US008674894B2

(12) United States Patent
Harak et al.

(10) Patent No.: US 8,674,894 B2
(45) Date of Patent: Mar. 18, 2014

(54) ANTENNA DESIGN

(75) Inventors: David J. Harak, Marshall, OK (US); Sean A. McLain, Guthrie, OK (US)

(73) Assignee: The Charles Machine Works, Inc., Perry, OK (US)

( * ) Notice: Subject to any disclaimer, the term of this patent is extended or adjusted under 35 U.S.C. 154(b) by 1188 days.

(21) Appl. No.: 12/503,603

(22) Filed: Jul. 15, 2009

(65) Prior Publication Data

US 2010/0013728 A1 Jan. 21, 2010

Related U.S. Application Data

(60) Provisional application No. 61/080,876, filed on Jul. 15, 2008.

(51) Int. Cl.
*H01Q 9/04* (2006.01)
*H01Q 1/04* (2006.01)
*H01Q 1/00* (2006.01)

(52) U.S. Cl.
USPC ..... 343/790; 343/719; 343/787

(58) Field of Classification Search
USPC ..... 343/790, 719, 787
See application file for complete search history.

(56) References Cited

U.S. PATENT DOCUMENTS

| | | | | | |
|---|---|---|---|---|---|
| 3,717,749 | A * | 2/1973 | Rogers | 235/450 |
| 4,384,605 | A * | 5/1983 | Schaeffer et al. | 160/38 |
| 4,413,262 | A * | 11/1983 | Johns | 343/722 |
| 4,803,491 | A * | 2/1989 | Hikuma | 343/702 |
| 4,893,077 | A * | 1/1990 | Auchterlonie | 324/207.17 |
| 5,264,795 | A * | 11/1993 | Rider | 324/326 |
| 5,334,271 | A * | 8/1994 | Bullock et al. | 156/51 |
| 5,641,141 | A * | 6/1997 | Goodwin | 248/218.4 |
| 2002/0017905 | A1 * | 2/2002 | Conti | 324/339 |
| 2003/0034697 | A1 * | 2/2003 | Goldner et al. | 310/17 |

* cited by examiner

*Primary Examiner* — Dameon Levi
*Assistant Examiner* — Graham Smith
(74) *Attorney, Agent, or Firm* — Tomlinson Rust McKinstry Grable

(57) ABSTRACT

An antenna core design. An antenna assembly is provided for use in tracking and locating equipment used to track and locate tools with underground drilling systems. The antenna assembly comprises an elongate core, a plurality of metal strips supported on an external surface of the core, an insulating material adapted to insulate each of the plurality of metal strips from the other metal strips and the core, and a wire disposed around the external surface of the strips. Alternatively the antenna assembly comprises an elongate core, an insulating material disposed around a perimeter of the core, and a wire disposed around the insulating material. The core has a plurality of slots cut from one end of the core so that the core defines a plurality of metal strips. A support ring is disposed on the internal surface of the core to support the metal strips.

12 Claims, 3 Drawing Sheets

ANTENNA DESIGN

CROSS REFERENCE TO RELATED APPLICATIONS

This application claims the benefit of U.S. Provisional Application No. 60/080,876 filed Jul. 15, 2008, the contents of which are incorporated fully herein by reference.

FIELD OF THE INVENTION

The present invention relates to the field of antennas and more particularly to alternative antenna cores for use in locating and tracking equipment.

SUMMARY OF THE INVENTION

The present invention is directed to an antenna assembly comprising an elongate core, a plurality of metal strips supported on an external surface of the core, the plurality of strips defining a perimeter; an insulating material adapted to insulate each of the plurality of metal strips from the other metal strips and the core, and a wire disposed around the perimeter formed by the strips.

In an alternative embodiment the invention is directed to an antenna assembly comprising an elongate core, the core defining a plurality of metal strips, an insulating material disposed around a perimeter of the core, and a wire disposed around the insulating material.

In yet another embodiment the invention is directed to an antenna assembly comprising an elongate core comprising a plurality of metal strips, an insulating material disposed on a surface of the metal strips, and a wire disposed around a perimeter of the core.

DETAILED DESCRIPTION OF THE INVENTION

Ferrite material is often used for antenna cores in locating and tracking equipment, and particularly in horizontal directional drilling (HDD) operations. Ferrite antenna cores are used as transmitters, such as when transmitting signals from underground tools, and as receivers, as in assemblies within walkover trackers used to detect signals from underground tools. There are some disadvantages associated with ferrite. These include inconsistencies (mechanical and electrical), varying properties due to temperature drift and brittleness. The brittle characteristics of ferrite cause issues when used in HDD products, especially products that are required to perform in harsh environments. Ferrite often breaks causing its properties to change, usually degrading the antenna's performance. Ferrite does have some important properties such as high permeability, magnetic characteristics, and high resistivity which make it a good antenna core.

Metal, which for the purpose of this document will also include steel, metal, alloys, or any other (non ferrite) magnetic material, can offer many of the benefits of ferrite but without some of the disadvantages. One skilled in the art will appreciate a drawback to metal, however, that is its low resistivity. The low resistivity of metal causes the metal to have "losses" when used as an antenna core. "Losses" is the term used for all the factors that cause magnetic material to be inefficient. Eddy currents, for example, account for most of the loss in magnetic materials. With metals used as a core, the induced magnetic fields would result in serious degradation of the signal produced by the metal antenna. The present invention and method of manufacture addresses these issues with a design of an antenna core using metal or non-ferrite material that significantly reduces losses from eddy currents.

Figure 1:
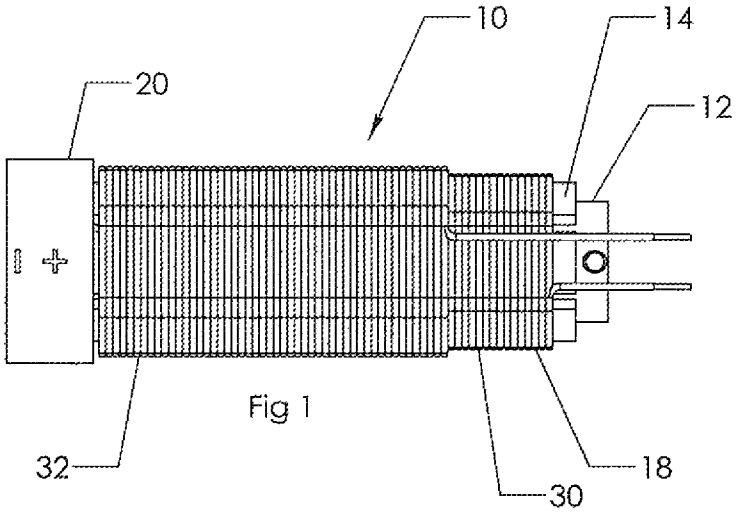
FIG. 1 is a side view of an antenna constructed in accordance with the present invention.
Figure 2:
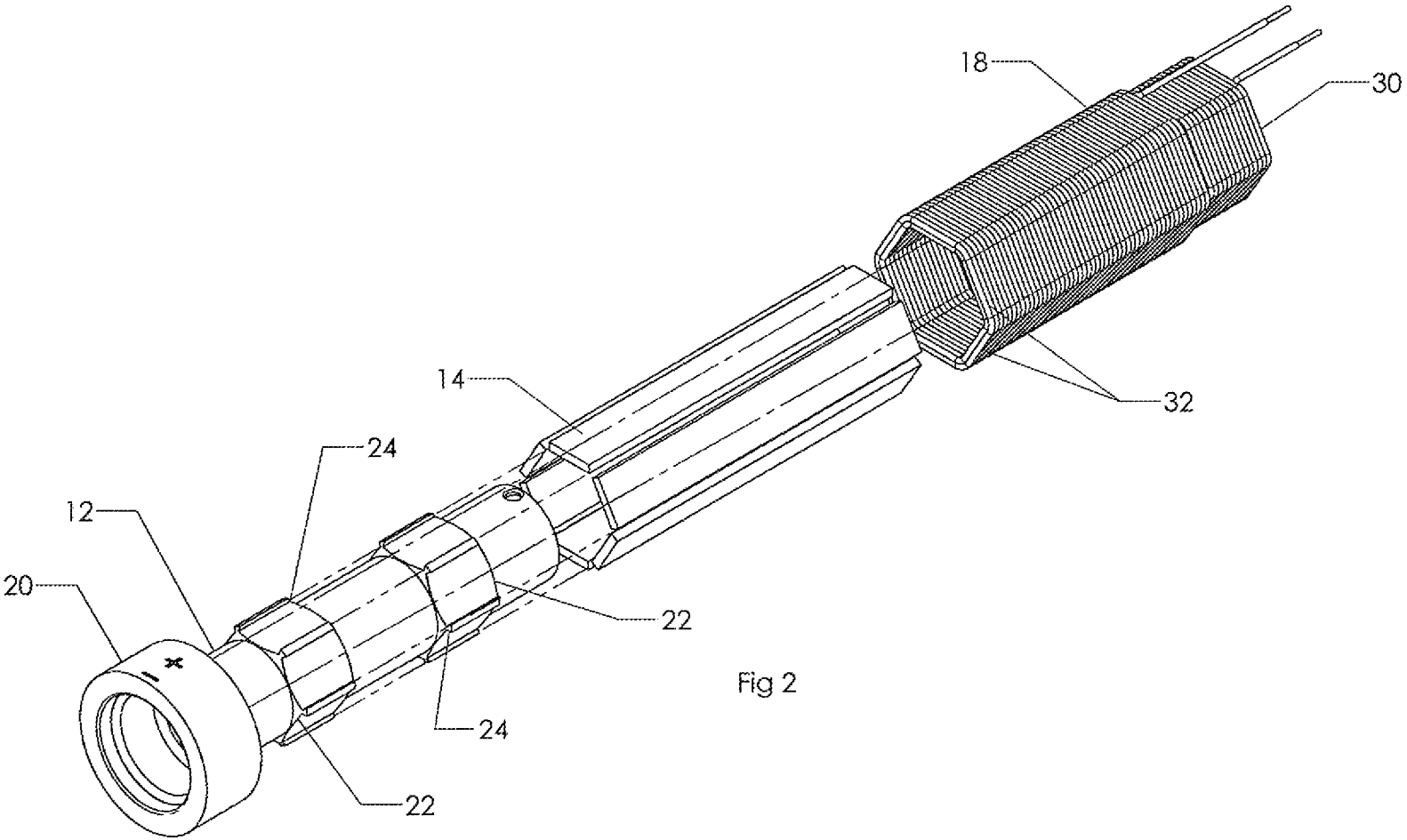
FIG. 2 is an exploded perspective view of the antenna shown in FIG. 1.

With reference now to the drawings in general and to FIGS. 1 and 2 in particular, there is shown therein a preferred embodiment for an antenna assembly constructed in accordance with the present invention. The antenna assembly, designated by reference number 10, comprises a core 12, a plurality of metal strips 14, an insulating layer 16, and a wire 18. The core 12 is preferably comprised of an inexpensive, easy to machine metal material. Preferably, the core 12 is elongate and tubular in shape and adapted to receive and support a power supply for the antenna 10. In the embodiment of in FIG. 1, a plurality of batteries (not shown) is used to power the antenna 10 and may be slid in an opening at a first end 20 of the core 12. A cap (not shown) is used to contain the batteries in the tubular core 12 and completes the electrical circuit.

The core 12 further comprises at least one support 22 positioned around a periphery of the core. Preferably, two supports 22 are disposed on the surface of the core 12. More preferably, the supports 22 will comprise a plurality of ridges or slots 24 adapted to receive the strips 14 in a manner yet to be described. Most preferably, the supports 22 will comprise six slots 24. The at least one support 22 may be integrally formed with the core 12 or secured to the surface of the core. As the core 12 is preferably a machinable metal, the at least one support 22 can be machined as part of the core tube. Alternatively, the at least one support 22 may be separately fashioned from metal or a nonconductive material and secured to the tube 12 by welding or other means.

The metal strips 14 are supported on the supports 22 around an external surface of the core 12. The metal strips 14 may be selected from a variety of metals will have very desirable antenna core properties and, particularly, high permeability. Additionally, as the strips 14 of a simple design, the metal material for the strips can include materials that are hard to machine. In the preferred embodiment, the metal strips 14 comprise a mu-metal, though other materials may also be used. Preferably, strips 14 are designed to have a rectangular cross-section and rest in the slots 24. The strips 14 may be held in place in the slots 24 with glue, resin, or other adhesive material or means. The strips 14, when placed on the supports 22 and slots 24, will define a perimeter around which the insulating material and wire may be placed in a manner yet to be described. Other shapes or forms for the strips 14 may be used, provided the application of the strips to the core 12 allows for a perimeter around the internal core 12 for application of the wire 18. Additionally, where constructing an antenna 10 for use with higher frequencies is desired, metal laminates may be used for the strips 14. Metal laminates would further increase resistivity and reduce eddy currents and losses associated with higher frequencies. One skilled in the art will appreciate metal laminates made by alternating very thin layers of metal with a thin layer of glue. The glue in this instance acts like the insulators. Having less metal between the insulators will help to break down the eddy currents.

Figure 3:
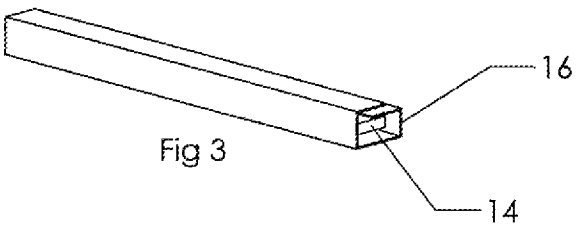
FIG. 3 is an illustration of an insulated metal strip for use in the present invention.

As is shown in FIG. 3, the antenna 10 further comprises the insulating layer 16, comprising an insulating material. The insulating layer 16 is necessary to keep the metal strips 14 electrically insulated from each other as well as the internal core 12 metal in order to obtain the best operating characteristics of the antenna 10. The insulating layer 16 is preferably in a form that is adapted to be wrapped around each of the strips 14 to electrically isolate each strip. The insulating material preferably comprises a non-conductive polyester tape, but could be other tape, heat shrink tubing, or any other non-conductive material. Once insulated, the strips 14 are placed in the supports 22 of the internal core 12 (see FIG. 2).

Referring again to FIG. 2, with the strips 14 in place on the internal core 12, the magnet wire 18 is wound around the perimeter to form the antenna assembly 10. Preferably, the wire 18 is wound around the perimeter in a first layer 30 and a second layer 32. More preferably, the first layer 30 extends substantially the full length of the strips 14 and the second layer 32 extends only a portion of the length of the strips. One skilled in the art will appreciate a resistance of the wire 18 can be adjusted and controlled by the amount of windings and how far along the length of the strips the wire is wound. The completed metal core assembly 10 would then be provided as an antenna used in locating and tracking equipment. Preferably, the antenna assembly 10 would be electrically connected to a computer board and programmed for operation as a transceiver or receiver antenna.

Figure 4:
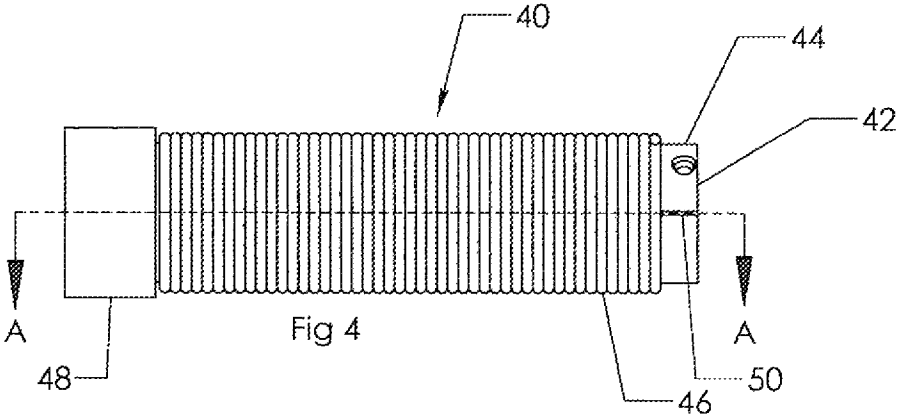
FIG. 4 is a side view of an alternative antenna construction.

With reference now to FIG. 4, there is shown therein an alternative antenna assembly 40 of the present invention. The antenna 40 comprises an internal core 42, an insulating layer 44, and a wire 46. The present embodiment also lessens the effects of eddy current losses while taking advantage of the magnetic characteristics and high permeability that some metals offer. In the embodiment of FIG. 4, the core 42 is comprised of a metal with desirable core properties, such as mu-metal. The core 42 is preferably tubular in shape and adapted to receive and support a power supply for the antenna 40. As described for the previous embodiment, a plurality of batteries (not shown) is used to power the present antenna 40 and may be slid in an opening at a first end 48 of the core 42. A cap (not shown) is used to contain the batteries in the tubular core 42 and completes the electrical circuit.

Figure 6:
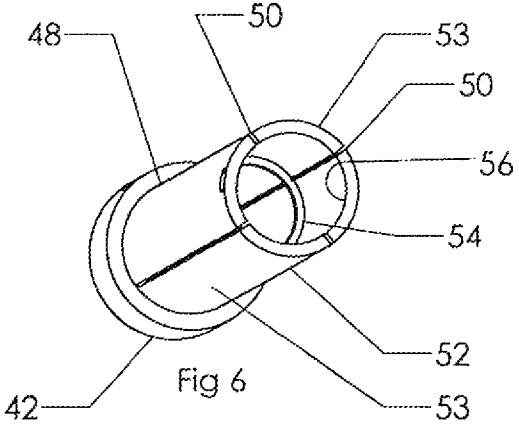
FIG. 6 is a perspective view of the core of the antenna shown in FIG. 4.
Figure 5:
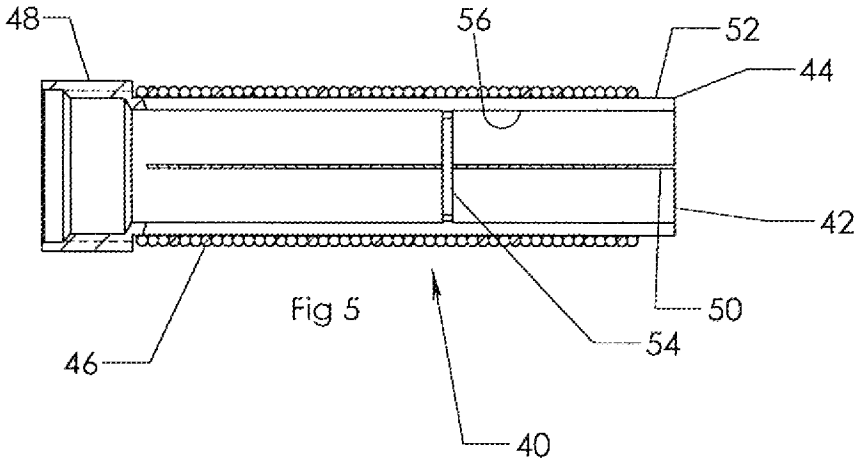
FIG. 5 is a side cut-away view of the antenna shown in FIG. 4, taken along the lines A-A.

Referring now to FIGS. 5 and 6, the core 42 is further characterized by a plurality of slots 50 machined or cut in the core. The slots 50 are preferably cut from a second end 52 of the core to a point proximate the first end 48 of the core. More preferably the core 42 comprises four (4) slots 50, defining six sections or strips 53 of metal in the core. One skilled in the art will also appreciate the slots 50 may be cut in other orientations, numbers, depths, or sizes, to define multiple sections of strips 53 that provide for taking advantage of lessening eddy currents. As discussed with regard to the embodiment in FIG. 1, metal laminates may be useful when constructing an antenna 40 for use with higher frequencies. The metal laminates could be used as the core 42 in the present embodiment. This core 42 could additionally take on any shape or form.

Preferably, the core 42 further comprises at least one support ring 54. The ring 54 is disposed on an internal surface 56 of the core 42. One skilled in the art will appreciate the ring 54 provides structural support for the core 42 and more particularly the strips 53 in an area where the slots 50 are cut. The ring 54 is preferably integral to the core 42 and machined or milled from the same metal and tube that forms the core. Alternatively, the ring 54 may be a separate piece secured to the internal surface 56.

The metal core 42 is then wrapped with the insulating layer 44. Preferably, the strips 53 are also wrapped with the insulating layer 44. The insulating layer 44 may comprise any insulating material for isolating the metal core 42 from the wire 46. The insulating material preferably comprises a non-conductive polyester tape, but could be other tape, heat shrink tubing, or any other non-conductive material. After the insulating layer 44 is in place, the magnet wire 46 is wrapped around the metal strips of the core 42 to form the antenna assembly 40. This metal core assembly 40 would then be provided as an antenna used in locating and tracking equipment. As above, preferably, the antenna assembly 40 is electrically connected to a computer board and programmed for operation as a transceiver or receiver antenna.

Various modifications can be made in the design and operation of the present invention without departing from the spirit thereof. Thus, while the principal preferred construction and modes of operation of the invention have been explained in what is now considered to represent its best embodiments, which have been illustrated and described, it should be understood that the invention may be practiced otherwise than as specifically illustrated and described.

What is claimed is:

1. An antenna assembly comprising:

an elongate core;

a plurality of metal strips supported on an external surface of the core, the plurality of strips defining a perimeter;

an insulating material adapted to insulate each of the plurality of metal strips from the other metal strips and the core; and a wire disposed around the perimeter formed by the strips.

2. The antenna assembly of claim 1 wherein the core comprises a metal tube.

3. The antenna assembly of claim 2 wherein the tube comprises at least one support adapted to maintain the metal strips in a position relative to the core.

4. The antenna assembly of claim 3 wherein the at least one support is integrally formed as part of the tube.

5. The antenna assembly of claim 3 wherein the at least one support comprises two supports and wherein each of the supports comprises a plurality of slots.

6. The antenna assembly of claim 1 wherein the insulating material comprises a non-conductive polyester tape.

7. The antenna assembly of claim 1 wherein the metal strips comprise mu-metal.

8. The antenna assembly of claim 7 wherein the metal strips are rectangular in cross-section.

9. The antenna assembly of claim 1 wherein the plurality of strips comprises six strips.

10. The antenna assembly of claim 1 further comprising an adhesive adapted to secure each of the plurality of metal strips to the core.

11. The antenna assembly of claim 1 wherein the wire is wrapped around the perimeter in a first layer and a second layer.

12. The antenna assembly of claim 11 wherein the first layer extends substantially the full length of the strips and the second layer extends only a portion of the length of the strips.

* * * * *